US009530429B2

(12) United States Patent
Sunohara et al.

(10) Patent No.: US 9,530,429 B2
(45) Date of Patent: Dec. 27, 2016

(54) REVERBERATION SUPPRESSION APPARATUS USED FOR AUDITORY DEVICE

(71) Applicant: RION CO., LTD., Kokubunji-Shi, Tokyo (JP)

(72) Inventors: Masahiro Sunohara, Kokubunji (JP); Mariko Nakaichi, Kokubunji (JP)

(73) Assignee: RION CO., LTD., Kokubunji-Shi, Tokyo (JP)

( * ) Notice: Subject to any disclaimer, the term of this patent is extended or adjusted under 35 U.S.C. 154(b) by 0 days.

(21) Appl. No.: 14/836,332

(22) Filed: Aug. 26, 2015

(65) Prior Publication Data

US 2016/0064011 A1 Mar. 3, 2016

(30) Foreign Application Priority Data

Sep. 3, 2014 (JP) ..... 2014-179656

(51) Int. Cl.
*G10L 21/034* (2013.01)
*H04R 3/00* (2006.01)
*G10L 21/0208* (2013.01)

(52) U.S. Cl.
CPC ..... *G10L 21/034* (2013.01); *G10L 21/0208* (2013.01); *H04R 3/00* (2013.01); *G10L 2021/02082* (2013.01)

(58) Field of Classification Search
CPC ..... G10L 21/0208; G10L 21/034; G10L 2021/02082; H04R 3/00
See application file for complete search history.

(56) References Cited

U.S. PATENT DOCUMENTS 7,856,353 B2 * 12/2010 Fukuda ..... G10L 15/20 381/63
8,073,147 B2 * 12/2011 Sugiyama ..... H04B 3/23 370/286
8,116,471 B2 * 2/2012 Derkx ..... G10L 21/02 381/66
8,284,947 B2 10/2012 Giesbrecht et al.
2012/0070011 A1 * 3/2012 Van Baelen ..... G01H 17/00 381/63

(Continued)

FOREIGN PATENT DOCUMENTS

JP 2006-157920 A 6/2006
JP 2007-065204 A 3/2007

*Primary Examiner* — Brenda Bernardi
(74) *Attorney, Agent, or Firm* — Troutman Sanders LLP

(57) ABSTRACT

A reverberation suppression apparatus includes: an instantaneous value calculation unit that calculates an instantaneous value/instantaneous values in an envelope of values correlating with the absolute value or the square of an input signal; a reverberation estimation unit that calculates an exponential moving average of the instantaneous value(s) as an estimated reverberation component; a gain derivation unit that derives a gain corresponding to the input signal according to the estimated reverberation component and the instantaneous value(s) when the each instantaneous value is larger than the estimated reverberation component, and derives a lower limit of the gain as the gain corresponding to the input signal when the each instantaneous value is smaller than the estimated reverberation component; a smoothing unit that performs a smoothing process on the gain; and a gain processing unit that applies the gain to amplitude adjustment of the input signal thereafter.

12 Claims, 5 Drawing Sheets

(56) References Cited

U.S. PATENT DOCUMENTS

| | | | | |
|---|---|---|---|---|
| 2013/0077798 | A1* | 3/2013 | Otani | G10L 21/0208 381/66 |
| 2013/0188798 | A1* | 7/2013 | Togawa | H04B 3/20 381/66 |
| 2015/0149160 | A1* | 5/2015 | Lou | G10L 21/0208 704/226 |

* cited by examiner

FIG. 2

$$G(k) = \left[ \frac{X(k)^a - R(k)^a}{X(k)^a} \right]^b \quad \cdots (1)$$

REVERBERATION SUPPRESSION APPARATUS USED FOR AUDITORY DEVICE

CROSS-REFERENCE TO RELATED APPLICATION

This application claims priority from Japanese Patent Application No. 2014-179656 filed with the Japan Patent Office on Sep. 3, 2014, the entire contents of which are hereby incorporated by reference.

BACKGROUND

1. Technical Field

This disclosure relates to a reverberation suppression apparatus used for auditory devices.

2. Related Art

There have been proposed various techniques for removing reverberations from acoustic signals. In one technique, acoustic signals are first collected, an inverse filter is generated according to the collected acoustic signals, and then the generated inverse filter is used to remove reverberation from the acoustic signals (for example, refer to JP-A-2007-065204 and JP-A-2006-157920).

SUMMARY

A reverberation suppression apparatus according to an embodiment of this disclosure includes: an instantaneous value calculation unit that calculates an instantaneous value/instantaneous values in an envelope of values correlating with the absolute value or the square of an input signal; a reverberation estimation unit that calculates an exponential moving average of the instantaneous value(s) as an estimated reverberation component; a gain derivation unit that derives a gain corresponding to the input signal according to the estimated reverberation component and the instantaneous value(s) for a period of time during which the each instantaneous value is larger than the estimated reverberation component, and derives a lower limit of the gain as the gain corresponding to the input signal for a period of time during which the each instantaneous value is smaller than the estimated reverberation component; a smoothing unit that performs a smoothing process on the gain derived by the gain derivation unit; and a gain processing unit that applies the gain after the smoothing process to amplitude adjustment of the input signal.

BRIEF DESCRIPTION OF DRAWINGS

FIG. 2 is an example of a calculation formula for use in derivation of a gain by a gain derivation unit 6 illustrated in FIG. 1;

FIG. 4A illustrates an example of the input signal;

FIG. 4B illustrates an example of instantaneous values and estimated reverberation components for one frequency band component included in the input signal illustrated in FIG. 4A;

FIG. 4C illustrates an example of the gains G1($k$) and G2($k$) based on the instantaneous values and the estimated reverberation components illustrated in FIG. 4B;

FIG. 4D illustrates an example of an output signal obtained by applying the gains corresponding to each of the predetermined number of frequency band components including the gains illustrated in FIG. 4C.

DETAILED DESCRIPTION

Figure 1:
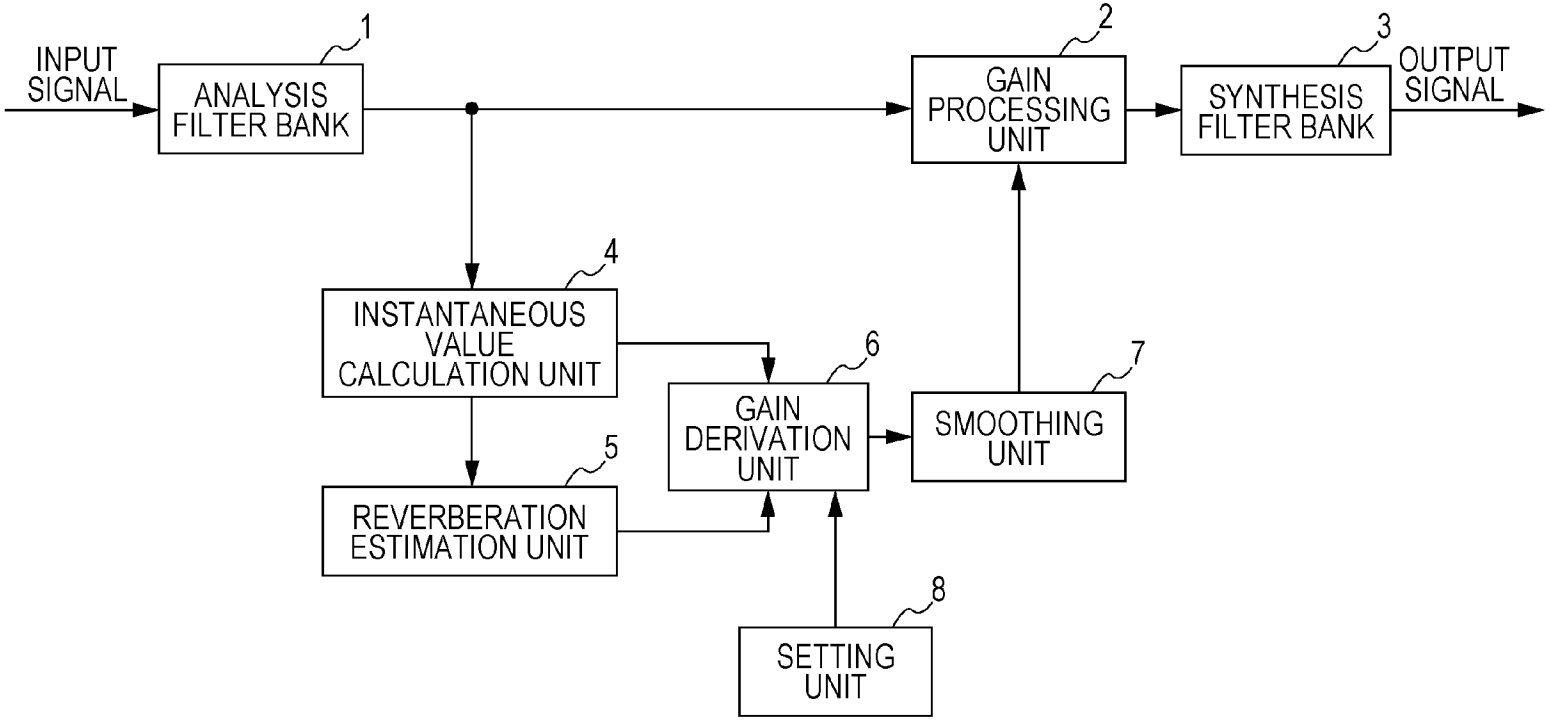
FIG. 1 is a block diagram illustrating a structure of a reverberation suppression apparatus according to a first embodiment of this disclosure.

In the following detailed description, for purpose of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

According to the conventional techniques, it is necessary to make a prior assessment of reverberations in indoor environments and the like (that is, generation of an inverse filter). It takes time to correctly assess reverberations. Decreasing the time taken for assessment of reverberations would cause a larger error in the inverse filter. This may deteriorate audio quality. Further, generating the inverse filter would increase the amount of data processing. To reduce the amount of time required for assessment, the processing speed of the apparatus needs to be made higher, which results in increase of costs for production of the apparatus.

In view of the foregoing problems, an object of this disclosure is to provide a reverberation suppression apparatus that suppresses reverberations by relatively simple data processing.

A reverberation suppression apparatus according to this disclosure includes: an instantaneous value calculation unit that calculates an instantaneous value/instantaneous values in an envelope of values correlating with the absolute value or the square of an input signal; a reverberation estimation unit that calculates an exponential moving average of the instantaneous value(s) as an estimated reverberation component; a gain derivation unit that derives a gain corresponding to the input signal according to the estimated reverberation component and the instantaneous value(s) for a period of time during which the each instantaneous value is larger than the estimated reverberation component, and derives a lower limit of the gain as the gain corresponding to the input signal for a period of time during which the each instantaneous value is smaller than the estimated reverberation component; a smoothing unit that performs a smoothing process on the gain derived by the gain derivation unit; and a gain processing unit that applies the gain after the smoothing process to amplitude adjustment of the input signal.

The reverberation suppression apparatus according to an embodiment of this disclosure suppresses reverberations by relatively simple data processing.

Embodiments of this disclosure will be described below with reference to the accompanying drawings.

First Embodiment

FIG. 1 is a block diagram illustrating a structure of a reverberation suppression apparatus according to a first embodiment of this disclosure. The reverberation suppression apparatus illustrated in FIG. 1 includes an analysis filter bank 1, a gain processing unit 2, a synthesis filter bank 3, an instantaneous value calculation unit 4, a reverberation estimation unit 5, a gain derivation unit 6, a smoothing unit 7, and a setting unit 8. For example, these components may be implemented by a digital signal processor (DSP). Alternatively, the functions of these components may be implemented by executing programs on a computer.

The analysis filter bank 1 divides an input signal (acoustic signal) into predetermined plural (for example, 32) frequency band components. The input signal contains speech sound.

The gain processing unit 2 applies a gain to each of the predetermined number of frequency band components divided by the analysis filter bank 1. At that time, the gain processing unit 2 applies a gain after smoothing by the smoothing unit 7 to amplitude adjustment of the input signal (which is each of the frequency band components).

The synthesis filter bank 3 synthesizes the predetermined number of frequency band components to which the gain processing unit 2 applies the gains to generate an output signal.

The instantaneous value calculation unit 4 calculates an instantaneous value/instantaneous values in an envelope of values correlating with the absolute value or the square of the input signal. In the first embodiment, the instantaneous value calculation unit 4 calculates an instantaneous value/instantaneous values in an envelope (time envelope) of power as values correlating with the square of the input signal. Alternatively, the absolute value of the input signal may be used as instantaneous value(s). In this example, the instantaneous value is calculated for each of the predetermined number of frequency band components in the input signal.

The reverberation estimation unit 5 calculates the exponential moving average of the instantaneous value(s) calculated by the instantaneous value calculation unit 4 as an estimated reverberation component. In this example, the estimated reverberation component is calculated for each of the predetermined number of frequency band components in the input signal. For example, the reverberation estimation unit 5 holds the instantaneous value at each point of time for a predetermined period of time from that point of time. The reverberation estimation unit 5 then calculates the exponential moving average at each point of time based on the instantaneous value held at that point of time.

The exponential moving average is a kind of weighted moving average. According to the exponential moving average, the weighting coefficient is attenuated in an exponential manner. For a period of time during which the estimated reverberation component is smaller than the instantaneous value, the reverberation estimation unit 5 attenuates the weighting coefficient of the exponential moving average by the use of a first time constant. For a period of time during which the estimated reverberation component is larger than the instantaneous value, the reverberation estimation unit 5 attenuates the weighting coefficient of the exponential moving average by the use of a second time constant smaller than the first time constant.

The gain derivation unit 6 derives a gain corresponding to the input signal according to the estimated reverberation component and the instantaneous value described above. At that time, for a period of time during which the instantaneous value is smaller than the estimated reverberation component, the gain derivation unit 6 derives a lower limit of the gain as the gain. In this example, the gain derivation unit 6 derives a gain corresponding to each of the predetermined number of frequency band components included in the input signal.

In the first embodiment, for a period of time during which the instantaneous value is larger than the estimated reverberation component, the gain derivation unit 6 derives a gain varying depending on the estimated reverberation component and the instantaneous value by the use of a predetermined characteristic parameter. For a period of time during which the instantaneous value is smaller than the estimated reverberation component, the gain derivation unit 6 derives a predetermined fixed value as the gain (hereinafter, referred to as gain lower limit).

In this example, the characteristic parameter is obtained by a predetermined calculation formula. FIG. 2 is an example of a calculation formula for use in derivation of a gain by the gain derivation unit 6 illustrated in FIG. 1. The calculation formula (1) described in FIG. 2 is a formula for deriving a gain G1($k$) for a k-th frequency band. In the formula, a denotes a first exponent and b denotes a second exponent. The difference between the a-th power of an instantaneous value X(k) and the a-th power of an estimated reverberation component R(k) is divided by the a-th power of the instantaneous value X(k), and then the resultant value is raised to the b-th power to calculate a gain G(k). For changeable sound such as speech sound, the gain G(k) provides the gain in accordance with the variations. For stationary noise, the gain G(k) operates to decrease the gain. When the gain G(k) is equal to or larger than the gain lower limit, the gain derivation unit 6 derives the gain G(k) as the gain G1($k$). When the gain G(k) is smaller than the gain lower limit, the gain derivation unit 6 derives the gain lower limit as the gain G1($k$).

For example, when the instantaneous value is a power value of the input signal (that is, the k-th frequency band component), the exponents are set as a=1 and b=½. When the instantaneous value is the absolute value of the input signal (that is, the k-th frequency band component), the exponents are set as a=2 and b=½.

The smoothing unit 7 performs a smoothing process (in a time-base direction) on the gain G1($k$) derived by the gain derivation unit 6. In this example, the smoothing process is performed on each of the gains of the predetermined number of frequency band components in the input signal.

In the first embodiment, the smoothing unit 7 performs the smoothing process to calculate the exponential moving average of the gain derived by the gain derivation unit 6. The smoothing unit 7 then outputs to the gain processing unit 2 the calculated exponential moving average as a gain G2($k$) after the smoothing process. At that time, the smoothing unit 7 compares the gain G1($k$) at a certain point of time with the immediately preceding gain G2($k$). When G1($k$)≥G2($k$), the smoothing unit 7 attenuates the weighting coefficient of the exponential moving average by the use of a third time constant. When G1($k$)<G2($k$), the smoothing unit 7 attenuates the weighting coefficient of the exponential moving average by the use of a fourth time constant larger than the third time constant.

The setting unit 8 sets the gain lower limit (for example, 0 decibel, −5 decibel, or −10 decibel) and the foregoing calculation formula (for example, the exponents a and b in the calculation formula) to the gain derivation unit 6. The setting unit 8 may set the gain lower limit and the calculation formula independently for each of the frequency bands. Alternatively, the setting unit 8 may set a single common gain lower limit to the certain number of frequency bands and the foregoing calculation formula.

Next, operations of the reverberation suppression apparatus according to the first embodiment will be described.

The analysis filter bank 1 divides the input signal (acoustic signal) into a predetermined number N of frequency band components. Then, the instantaneous value calculation unit 4, the reverberation estimation unit 5, the gain derivation unit 6, the smoothing unit 7, and the setting unit 8 separately perform processes on each of the frequency bands as described below.

The instantaneous value calculation unit 4 calculates an instantaneous value/instantaneous values X(k) (k=1, . . . , N) in an envelope at each point of time as described above. The reverberation estimation unit 5 calculates the exponential moving average of the each instantaneous value X(k) as the estimated reverberation component R(k). The gain derivation unit 6 derives the gain G1(*k*) at each point of time according to the each instantaneous value X(k) and the estimated reverberation component R(k). The smoothing unit 7 performs the smoothing process on the gain G(k) derived by the gain derivation unit 6 along the time-base direction. The smoothing unit 7 then outputs to the gain processing unit 2 the gain G2(*k*) after the smoothing process.

Figure 3:
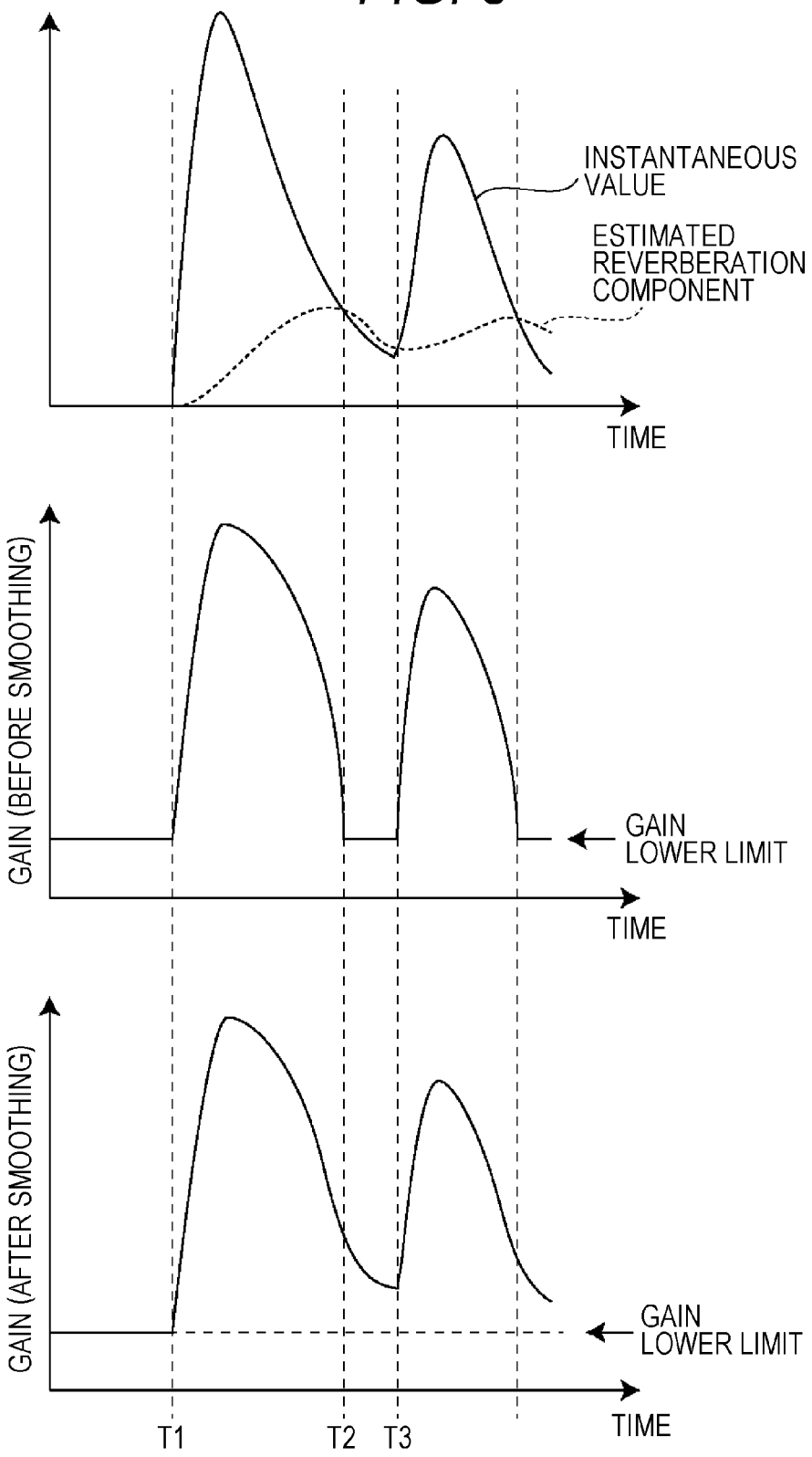
FIG. 3 is a chart illustrating gains obtained at the reverberation suppression apparatus according to the first embodiment.

FIG. 3 is a chart illustrating gains obtained at the reverberation suppression apparatus according to the first embodiment. First, prior to a time T1 described in FIG. 3, the amplitude of the input signal (in this example, the k-th frequency band component) may be continuously zero. Accordingly, the instantaneous value X(k) and the estimated reverberation component R(k) become zero. Therefore, the gain G1(*k*) derived by the gain derivation unit 6 becomes the gain lower limit.

After that, at the time T1, when the amplitude of the input signal appears, the instantaneous value X(k) rises. Then, the estimated reverberation component R(k) rises with a lag behind the instantaneous value X(k). Then, as the amplitude of the input signal becomes lesser, the instantaneous value X(k) becomes immediately smaller. However, the estimated reverberation component R(k) becomes smaller with a lag. Accordingly, the instantaneous value X(k) and the estimated reverberation component R(k) may cross each other. The time when the instantaneous value X(k) and the estimated reverberation component R(k) become equal is designated as a time T2. That is, during a period of time from the time T1 to the time T2, the estimated reverberation component R(k) is smaller than the instantaneous value X(k). Then, after the passage of the time T2, the estimated reverberation component R(k) is larger than the instantaneous value X(k). At the reverberation suppression apparatus according to the first embodiment of this disclosure, the sound in the time frame with X(k)<R(k) is regarded as late reverberation sound. By decreasing the gain G1(*k*) in the time frame to the lower limit, the late reverberation sound can be suppressed in an easy and effective manner.

Accordingly, from the time T1 to the time T2, the gain G1(*k*) derived by the gain derivation unit 6 is the gain G(k) calculated by the calculation formula (1) (when the gain is equal to or larger than the lower limit) After the passage of the time T2, until the time T3 when the instantaneous value X(k) exceeds again the estimated reverberation component R(k), the gain G1(*k*) derived by the gain derivation unit 6 is fixed to the gain lower limit.

When the reverberation suppression apparatus according to the first embodiment is applied to auditory devices, changes in the gain G1(*k*) are steep at the times T1, T2, and T3. Accordingly, the sound after processing may be very hard to hear. To solve this problem, the smoothing process is performed on the gain G1(*k*).

As illustrated in FIG. 3, the smoothing unit 7 suppresses steep changes in the gain G1(*k*). Thus the gain processing unit 2 uses the gain G2(*k*) with steep changes suppressed.

In such a manner as described above, the gain G2(*k*) can be obtained at each point of time.

The gain processing unit 2 then applies the corresponding gain G2(*k*) obtained by the smoothing unit 7 to each of the predetermined number of frequency band components. The synthesis filter bank 3 synthesizes the predetermined number of frequency band components to which the gain processing unit 2 applies the gains to generate an output signal.

FIG. 4 is a chart illustrating a specific example of late reverberation suppression by the reverberation suppression apparatus according to the first embodiment. FIG. 4A illustrates an example of the input signal. FIG. 4B illustrates an example of instantaneous values and estimated reverberation components for one frequency band component included in the input signal illustrated in FIG. 4A. FIG. 4C illustrates an example of the gains G1(*k*) and G2(*k*) based on the instantaneous values and the estimated reverberation components illustrated in FIG. 4B. FIG. 4D illustrates an example of an output signal obtained by applying the gains corresponding to each of the predetermined number of frequency band components including the gains illustrated in FIG. 4C.

Figure 4A:
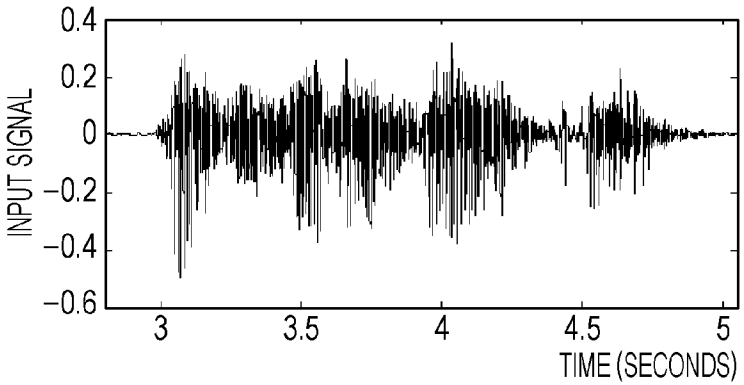
FIGS. 4A-D are charts illustrating a specific example of late-reverberation suppression by the reverberation suppression apparatus according to the first embodiment.
Figure 4B:
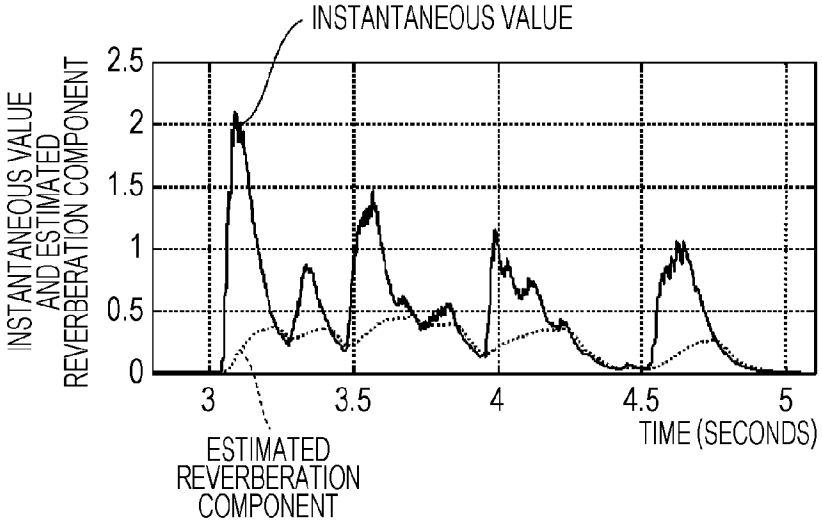
Figure 4C:
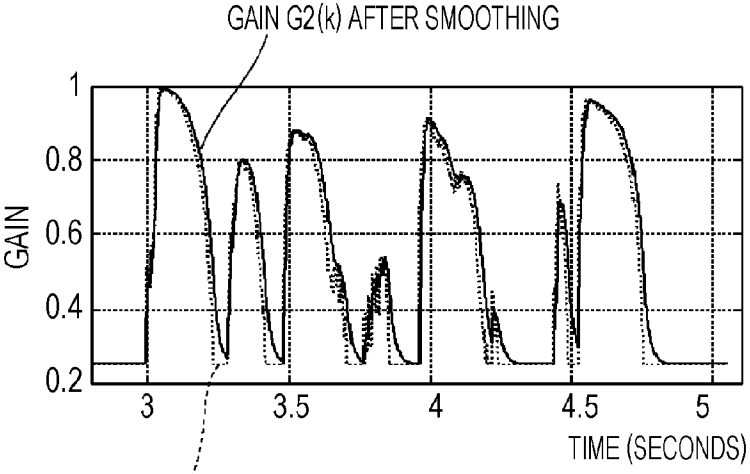
Figure 4D:
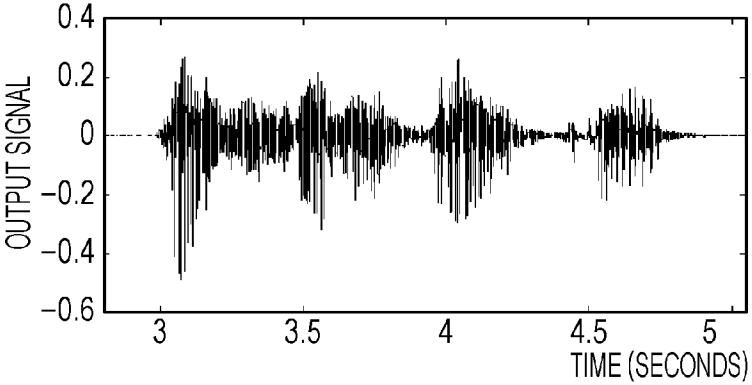

As illustrated in FIGS. 4B and 4C, for the period of time during which the instantaneous value X(k) is smaller than the estimated reverberation component R(k) (that is, for the period of time during which it is estimated that the reverberation component is more prominent than the component of direct sound or initial reflected sound), the gain G1(*k*) is kept at the lower limit as for the period of time during which the amplitude of the input signal is continuously zero. For the period of time during which the instantaneous value X(k) is larger than the estimated reverberation component R(k) (that is, for the period of time during which it is estimated that the component of direct sound or initial reflected sound is more prominent than the reverberation component), the gain G1(*k*) fluctuates as G(k) calculated by the calculation formula (1). By adjusting the gain in this manner, it is possible to suppress the amplitude of the output signal for the period of time during which the late reverberation component is more prominent as illustrated in FIG. 4D.

As described above, according to the first embodiment, the instantaneous value calculation unit 4 calculates the instantaneous value(s) in an envelope of values correlating with the absolute value or the square of an input signal. The reverberation estimation unit 5 calculates an exponential moving average of the instantaneous value(s) as an estimated reverberation component. For the period of time during which the instantaneous value is larger than the estimated reverberation component, the gain derivation unit 6 derives the gain corresponding to the input signal according to the estimated reverberation component and the instantaneous value. For the period of time during which the instantaneous value is smaller than the estimated reverberation component, the gain derivation unit 6 derives a lower limit of the gain as the gain. The smoothing unit 7 performs the smoothing process on the gain derived by the gain derivation unit 6. The gain processing unit 2 applies the gain after the smoothing process to amplitude adjustment of the input signal.

Accordingly, it is possible to suppress reverberations by relatively simple data processing.

Second Embodiment

Figure 5:
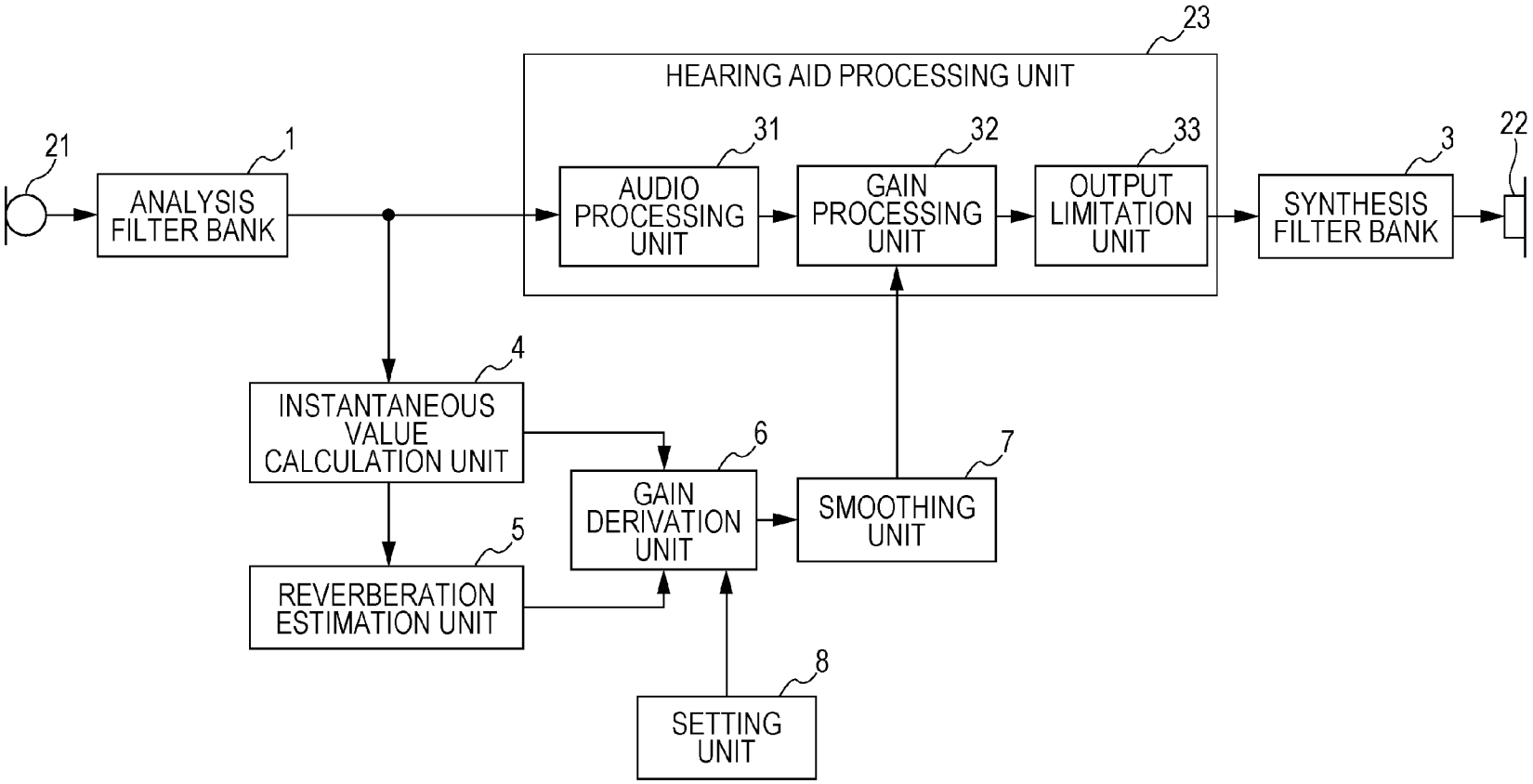
FIG. 5 is a block diagram illustrating a structure of a hearing aid according to a second embodiment of this disclosure.

In the second embodiment, the reverberation suppression apparatus according to the first embodiment of this disclosure is applied to a hearing aid. FIG. 5 is a block diagram illustrating a structure of a hearing aid according to a second embodiment of this disclosure.

The hearing aid illustrated in FIG. 5 includes a microphone 21, an receiver 22, and a hearing aid processing unit 23. The microphone 21 detects sound and outputs an acoustic signal according to the detected sound. The acoustic signal is input into the receiver 22. The receiver 22 outputs sound according to the input acoustic signal.

The hearing aid processing unit 23 has an audio processing unit 31, a gain processing unit 32, and an output limitation unit 33. The audio processing unit 31 performs signal processes such as noise reduction and spectrum enhancement for each of the foregoing frequency bands. The gain processing unit 32 applies the corresponding gain to each of the frequency bands as the gain processing unit 2 does. The output limitation unit 33 limits output sound pressure so as not to exceed a predetermined maximum acoustic pressure.

Other components of the second embodiment are the same as those of the first embodiment. Thus, descriptions thereof will be omitted here.

In the second embodiment, the acoustic signal output from the microphone 21 is input into the analysis filter bank 1 via an A/D (analog to digital) conversion unit not illustrated. After that, the gains derived in the same manner as in the first embodiment are input into the gain processing unit 32. Then, the frequency band components output from the output limitation unit 33 (that is, the hearing aid processing unit 23) are input into the synthesis filter bank 3. Then, the output signal from the synthesis filter bank 3 is output to the receiver 22 via a D/A (digital to analog) conversion unit not illustrated, an amplifier and so on.

The foregoing embodiments are preferred examples of embodiments of this disclosure. However, embodiments of this disclosure are not limited to the foregoing embodiments. The embodiments described above can be modified and changed in various manners without deviating from the gist of the embodiments of this disclosure.

For example, in the first and second embodiments, the input signal may be a digital signal or an analog signal.

In the first embodiment, in the case of processing an acoustic signal with a narrow frequency distribution, the acoustic signal may be processed as an acoustic signal in a single frequency band without the use of a filter bank.

In the first and second embodiments, the late reverberation suppression may be applied to only some of the frequency bands at the lower frequency out of the predetermined number of frequency bands (for example, the frequency bands of 1 kHz or less, the seven frequency bands at the lower frequency out of the 32 frequency bands, or the like).

The reverberation suppression apparatus according to the first embodiment may be used for collecting and recording sound in a space with large reverberations such as in a tunnel, for example.

This disclosure may be applied to a hearing aid or the like, for example.

The reverberation suppression apparatus in this disclosure may be one of the following first to fifth reverberation suppression apparatuses:

The first reverberation suppression apparatus includes: an instantaneous value calculation unit that calculates an instantaneous value/instantaneous values in an envelope of values correlating with the absolute value or the square of an input signal; a reverberation estimation unit that calculates an exponential moving average of the instantaneous value(s) calculated by the instantaneous value calculation unit, as an estimated reverberation component; a gain derivation unit that derives a gain for the input signal based on the estimated reverberation component and the instantaneous value(s) for a period of time during which the each instantaneous value is larger than the estimated reverberation component, and sets the gain to a lower limit for a period of time during which the each instantaneous value is smaller than the estimated reverberation component; a smoothing unit that performs a smoothing process on the gain derived by the gain derivation unit; and a gain processing unit that applies the gain after the smoothing process to amplitude adjustment of the input signal.

The second reverberation suppression apparatus is based on the first reverberation suppression apparatus in which the gain derivation unit changes the gain according to the estimated reverberation component and the instantaneous value with a predetermined characteristic for a period of time during which the estimated reverberation component is smaller than the instantaneous value, and fixes the gain to a predetermined value for a period of time during which the estimated reverberation component is larger than the instantaneous value.

The third reverberation suppression apparatus is based on the second reverberation suppression apparatus in which the characteristic is based on a calculation formula by which, when a is a first exponent and b is a second exponent, the difference between the a-th power of the instantaneous value and the a-th power of the estimated reverberation component is divided by the a-th power of the instantaneous value, and the resultant value is raised to the b-th power and the raised value is set as the gain.

The fourth reverberation suppression apparatus is based on any of the first to third reverberation suppression apparatuses in which the smoothing unit performs the smoothing process to calculate the exponential moving average of the gain derived by the gain derivation unit and set the calculated exponential moving average as a gain after the smoothing process.

The fifth reverberation suppression apparatus is based on any of the first to fourth reverberation suppression apparatuses, further including an analysis filter bank that divides an input signal into a predetermined number of frequency band components and a synthesis filter bank, in which the gain processing unit applies a gain to each of the predetermined number of frequency band components, the synthesis filter bank synthesizes the predetermined number of frequency band components to which the gain is applied by the gain processing unit, the instantaneous value calculation unit, for each of the predetermined number of frequency band components, calculates an instantaneous value/instantaneous values in an envelope of values correlating with the absolute value or the square of the component, the reverberation estimation unit calculates the exponential moving average of the instantaneous value(s) calculated by the instantaneous value calculation unit for each of the predetermined number of frequency band components, as an estimated reverberation component, the gain derivation unit, for each of the predetermined number of frequency band components, derives a gain for the input signal based on the estimated reverberation component and the instantaneous value for the period of time during which the instantaneous value is larger than the estimated reverberation component, and fixes the gain to a lower limit for the period of time during which the instantaneous value is smaller than the estimated reverberation component, the smoothing unit performs a smoothing process on the gain derived by the gain derivation unit for each of the predetermined number of frequency band components, and the gain processing unit applies the gains after the smoothing process to the predetermined number of frequency band components.

The foregoing detailed description has been presented for the purposes of illustration and description. Many modifications and variations are possible in light of the above teaching. It is not intended to be exhaustive or to limit the subject matter described herein to the precise form disclosed. Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims appended hereto.

What is claimed is:

1. A reverberation suppression apparatus comprising:

an instantaneous value calculation unit that calculates an instantaneous value/instantaneous values in an envelope of values correlating with the absolute value or the square of an input signal;

a reverberation estimation unit that calculates an exponential moving average of the instantaneous value(s) as an estimated reverberation component;

a gain derivation unit that derives a gain corresponding to the input signal according to the estimated reverberation component and the instantaneous value(s) for a period of time during which the each instantaneous value is larger than the estimated reverberation component, and derives a lower limit of the gain as the gain corresponding to the input signal for a period of time during which the each instantaneous value is smaller than the estimated reverberation component;

a smoothing unit that performs a smoothing process on the gain derived by the gain derivation unit; and a gain processing unit that applies the gain after the smoothing process to amplitude adjustment of the input signal.

2. The reverberation suppression apparatus according to claim 1, wherein the gain derivation unit derives the gain varying according to the estimated reverberation component and the instantaneous value(s) with a predetermined characteristic parameter for the period of time during which the instantaneous value is larger than the estimated reverberation component, and the lower limit is a predetermined constant for the period of time during which the instantaneous value is smaller than the estimated reverberation component.

3. The reverberation suppression apparatus according to claim 2, wherein the predetermined characteristic parameter includes a first exponent a and a second exponent b, and is obtained by a calculation formula by which the difference between the a-th power of the instantaneous value and the a-th power of the estimated reverberation component is divided by the a-th power of the instantaneous value, and the resultant value is raised to the b-th power.

4. The reverberation suppression apparatus according to claim 1, wherein the smoothing process is to calculate the exponential moving average of the gain derived by the gain derivation unit.

5. The reverberation suppression apparatus according to claim 2, wherein the smoothing process is to calculate the exponential moving average of the gain derived by the gain derivation unit.

6. The reverberation suppression apparatus according to claim 3, wherein the smoothing process is to calculate the exponential moving average of the gain derived by the gain derivation unit.

7. The reverberation suppression apparatus according to claim 1, further comprising an analysis filter bank and a synthesis filter bank, wherein the analysis filter bank divides the input signal into a predetermined number of frequency band components, the values correlating with the absolute value or the square of the input signal are values correlating with the absolute value or the square of each of the predetermined number of frequency band components, the gain corresponding to the input signal is a gain corresponding to each of the predetermined number of frequency band components, the gain processing unit applies the corresponding gain after the smoothing process to amplitude adjustment of each of the predetermined number of frequency band components, and the synthesis filter bank synthesizes the predetermined number of frequency band components after the gain processing.

8. The reverberation suppression apparatus according to claim 2, further comprising an analysis filter bank and a synthesis filter bank, wherein the analysis filter bank divides the input signal into a predetermined number of frequency band components, the values correlating with the absolute value or the square of the input signal are values correlating with the absolute value or the square of each of the predetermined number of frequency band components, the gain corresponding to the input signal is a gain corresponding to each of the predetermined number of frequency band components, the gain processing unit applies the corresponding gain after the smoothing process to amplitude adjustment of each of the predetermined number of frequency band components, and the synthesis filter bank synthesizes the predetermined number of frequency band components after the gain processing.

9. The reverberation suppression apparatus according to claim 3, further comprising an analysis filter bank and a synthesis filter bank, wherein the analysis filter bank divides the input signal into a predetermined number of frequency band components, the values correlating with the absolute value or the square of the input signal are values correlating with the absolute value or the square of each of the predetermined number of frequency band components, the gain corresponding to the input signal is a gain corresponding to each of the predetermined number of frequency band components, the gain processing unit applies the corresponding gain after the smoothing process to amplitude adjustment of each of the predetermined number of frequency band components, and the synthesis filter bank synthesizes the predetermined number of frequency band components after the gain processing.

10. The reverberation suppression apparatus according to claim 4, further comprising an analysis filter bank and a synthesis filter bank, wherein the analysis filter bank divides the input signal into a predetermined number of frequency band components, the values correlating with the absolute value or the square of the input signal are values correlating with the absolute value or the square of each of the predetermined number of frequency band components, the gain corresponding to the input signal is a gain corresponding to each of the predetermined number of frequency band components, the gain processing unit applies the corresponding gain after the smoothing process to amplitude adjustment of each of the predetermined number of frequency band components, and the synthesis filter bank synthesizes the predetermined number of frequency band components after the gain processing.

11. The reverberation suppression apparatus according to claim 5, further comprising an analysis filter bank and a synthesis filter bank, wherein the analysis filter bank divides the input signal into a predetermined number of frequency band components, the values correlating with the absolute value or the square of the input signal are values correlating with the absolute value or the square of each of the predetermined number of frequency band components, the gain corresponding to the input signal is a gain corresponding to each of the predetermined number of frequency band components, the gain processing unit applies the corresponding gain after the smoothing process to amplitude adjustment of each of the predetermined number of frequency band components, and the synthesis filter bank synthesizes the predetermined number of frequency band components after the gain processing.

12. The reverberation suppression apparatus according to claim 6, further comprising an analysis filter bank and a synthesis filter bank, wherein the analysis filter bank divides the input signal into a predetermined number of frequency band components, the values correlating with the absolute value or the square of the input signal are values correlating with the absolute value or the square of each of the predetermined number of frequency band components, the gain corresponding to the input signal is a gain corresponding to each of the predetermined number of frequency band components, the gain processing unit applies the corresponding gain after the smoothing process to amplitude adjustment of each of the predetermined number of frequency band components, and the synthesis filter bank synthesizes the predetermined number of frequency band components after the gain processing.

* * * * *